US005230373A

United States Patent [19]

Engler

[11] Patent Number: 5,230,373

[45] Date of Patent: Jul. 27, 1993

[54] PISTON FILLER

[75] Inventor: Manfred W. Engler, Port Huron, Mich.

[73] Assignee: EME Engler USA Corp., Port Huron, Mich.

[21] Appl. No.: 754,397

[22] Filed: Sep. 3, 1991

[51] Int. Cl.[5] ..... B65B 3/12

[52] U.S. Cl. ..... 141/147; 141/146; 141/91; 141/258; 141/71; 222/148; 222/168.5; 222/380

[58] Field of Search ..... 141/12, 71, 73, 89-91, 141/144-147, 258-262, 237, 242-245; 222/168.5, 148, 380, 378

[56] References Cited

U.S. PATENT DOCUMENTS 1,046,762 12/1912 Fleming et al. ..... 141/146 X
1,073,067 9/1913 Ayars ..... 141/146
1,359,367 11/1920 Hansen ..... 141/146 X
1,468,254 9/1923 Ayars ..... 141/146 X
2,141,618 12/1938 Roge ..... 141/147 X
2,563,863 8/1951 Nordquist ..... 141/147
2,684,804 7/1954 Huntar et al. ..... 141/147 X
3,040,787 6/1962 Knoll ..... 141/147 X
3,097,672 7/1963 Minard ..... 141/147 X
3,830,264 8/1974 Billett et al. ..... 141/147 X
3,850,345 11/1974 Merritt ..... 222/168.5

*Primary Examiner*—Henry J. Recla
*Assistant Examiner*—Casey Jacyna
*Attorney, Agent, or Firm*—Harness, Dickey & Pierce

[57] ABSTRACT

A piston filler apparatus as disclosed in which the filler pistons and associated reciprocal valves are disposed below the product containing bowl so that they can be withdrawn into the bowl to effect easy in-place cleaning. A method of in-place cleaning is also disclosed, as well an an alternate method of operation.

12 Claims, 3 Drawing Sheets

PISTON FILLER

BACKGROUND OF THE INVENTION

The present invention relates to container filling equipment for the food and beverage industry, and more particularly to an improved piston filler apparatus.

In the food industry, one of the most demanding requirements is cleanliness. Every nook and cranny of every piece of equipment which is exposed to food (and many which are not) must be thoroughly cleaned at regular and frequent intervals. With respect to conventional piston fillers, this usually requires the disassembly and subsequent reassembly of a large number of valve cocks, seals, the piston assemblies, etc., each time the apparatus is cleaned. This is obviously a time consuming operation which can significantly increase production costs. In addition, many piston fillers operate to meter the product to be dispensed utilizing the vacuum created by the movement of a piston out of its filler cylinder. Although this is satisfactory for most food products, there are some which are so dense or heavy (such as pet food or the like) that they do not readily flow into the cylinder, thus creating air voids and an under-filled container.

It is therefore a primary object of the present invention to provide a piston filler apparatus which avoids the aforesaid cleaning problems, and which has an optional mode of operation for use with dense foods which does not rely on the use of a vacuum.

The virtue of the invention lies in its simplicity; having no complicated seals, no valves requiring disassembly for cleaning, a simple clean-in-place cycle, an optional dense-food cycle, and the like. This is in part accomplished by locating the filler pistons below the product-containing bowl and the valve actuating mechanism above the bowl.

These and other objects will become apparent to one skilled in the art upon a study of the following specification and by reference to the accompanying drawings.

DESCRIPTION OF THE PREFERRED EMBODIMENT

Figure 1:
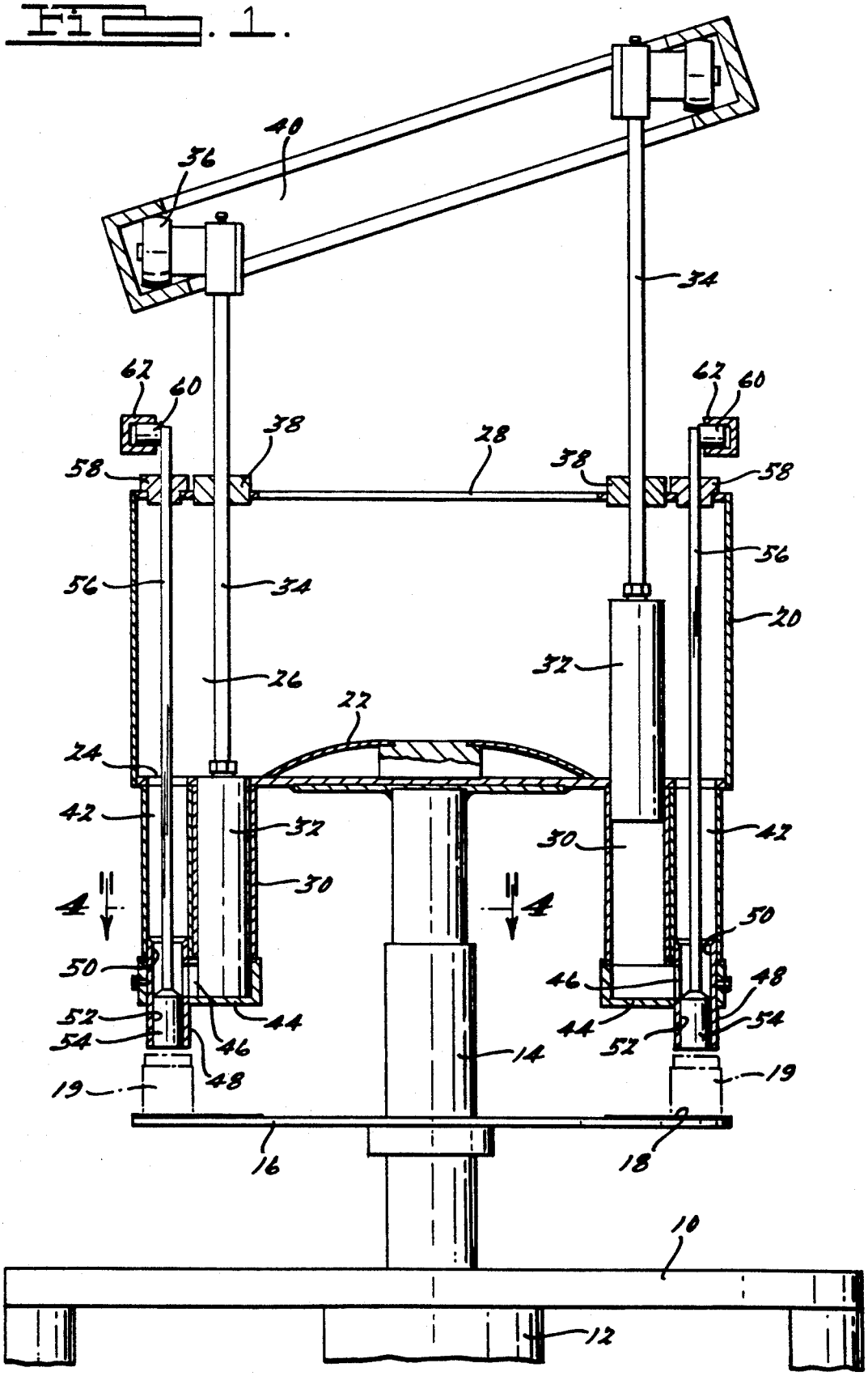
FIG. 1 is a somewhat diagrammatic vertical sectional view taken through the center of a piston filler apparatus embodying the principles of the present invention, showing filling cylinders in two different filling positions.

With reference primarily to FIG. 1, the filling apparatus of the present invention generally comprises a stationary base 10 having affixed thereto a motor 12 connected to a vertically extending shaft 14 which is journalled on the base in the usual manner. Affixed to shaft 14 for rotation therewith is a generally circular and horizontal platform 16 having a generally annular container supporting surface 18 on the upper face thereof, substantially coaxial with the axis of shaft 14.

The product (not shown) to be filled into the containers, indicated in phantom at 19, is contained within a generally circular cylindrical bowl 20 which is affixed to shaft 14 for rotation therewith, bowl 20 being generally coaxial with the rotational axis of the shaft and being disposed above platform 16. As can be seen, the bowl and platform are roughly the same diameter. An arched dome 22 is affixed to the bottom of bowl 20 in a central location for causing product in the bowl to flow radially outwardly under the influence of gravity to the outer peripheral generally annular bottom surface 24 of the bowl, thereby creating a filling zone 26 from which product can be transferred to containers 19 on the supporting surface of the platform. Bowl 20 is open at the top as is indicated at 28. The apparatus as described up to this point is of conventional construction.

The apparatus further comprises a plurality of generally vertical circular piston cylinders 30 which are located below bowl 20 so that they depend downwardly from the bottom of the bowl adjacent the outer periphery thereof. Each of the piston cylinders 30, which act as filler cylinders, are equally spaced around the bowl periphery and all of them are of substantially the same length, with the upper ends thereof being open and in communication with the interior of bowl 20 in filling zone 26. Each cylinder 30 has a filler piston 32 mounted for reciprocating movement therein in a relatively close-fit relationship. If desired, a simple sleeve of low friction material may be used as a cylinder liner. The top of each piston has affixed thereto a generally vertically extending piston rod 34 having at its upper end a roller follower 36 of the construction best illustrated in FIG. 2. Piston rods 34 are preferably square in cross section and pass through suitable square holes in bushings 38 non-rotatably affixed to the upper surface of bowl 20. This insures that the rotational axis of roller follower 36 will always be on a radial line passing through the center axis of shaft 14.

Follower 36 engages a conventional piston filler adjustable cam 40 in the manner best illustrated in FIG. 1. As can be seen, cam 40 is essentially annular in overall configuration and C-shaped in section. It is double acting in the sense that the follower is cammed both upwardly and downwardly by cam 40. The latter is fully adjustable in the conventional manner in order to determine the minimum and maximum stroke positions of pistons 32 in accordance with known principles for the purpose of metering the correct volume of product into the specific size container being filled. Since cam 40 is normally stationary, it is the rotation of bowl 20 and hence each of the pistons 32 which causes followers 36 to travel around the periphery of cam 40 to thereby be actuated upwardly and downwardly between the positions indicated.

Disposed directed radially outwardly from each piston cylinder 30 is a generally vertical circular valve cylinder 42 also depending downwardly from the bottom of bowl 20 adjacent one of the piston cylinders, each of the valve cylinders 42 having the upper end thereof open and in communication with the interior of bowl 20 in filling zone 26. As can be seen, each valve cylinder 42 is closely adjacent and radially aligned with a corresponding piston cylinder 30. The bottom open ends of each of the cylinders, which are approximately the same length, are enclosed by means of a cap 44 which defines a passageway 46 between the lower ends of each piston cylinder and its adjacent valve cylinder. Each of the caps 44 has an opening in the bottom thereof in line with the corresponding valve cylinder, and disposed therein is a sleeve 48 which at its lower end acts as a dispensing nozzle and which on its inside surface further defines a upper valve seat 50 and a lower valve seat 52 disposed above and below passage 46, respectively.

Slidably and sealingly disposed within sleeve 48, with a relatively close fit, is a cylindrical valve element 54. Valve element 54 is actuated in a vertical direction back and forth between a lower position in which it is sealingly engaging seat 52 and an upper position in which it is sealingly engaging seat 50 by means of a valve rod 56 of square configuration passing through a square hole in a suitable bushing 58 in the top wall of bowl 20. The upper end of each rod 56 is provided with a roller follower 60 adapted for rotation about a horizontal radial axis passing through the center axis of shaft 14. Each rod 56 and its valve 54 is reciprocating vertically between the two aforesaid positions by virtue of the engagement of follower 60 with a C-shaped cam 62, as can be readily visualized. Cam 62 is shown only in cross-section in FIG. 1 but in fact would be a continuous annular ring having the vertical displacements at the correct positions to achieve the desired operation, as will be discussed in greater detail hereinbelow. This arrangement of pistons and valves reduces product leakage. Known machines of the type which have both the filler pistons and the valve actuating mechanisms disposed below the bowl suffer the diadvantage that there can be undesirable product leakage through the openings which are used to connect the valves to the actuating cams, because in such an arrangement these openings are below the product and are under pressure.

The operation of the apparatus follows, in its normal operation, the following sequence:

A. This is the end of container filling and beginning of cylinder filling position shown on the left hand side of FIG. 1. In this position the piston is at its normal maximum down position and the valve is in its normal maximum down position, and container 19 has just been completely filled with a metered quantity of food product.

B. This is the end of cylinder fill position and is shown at the right hand portion of FIG. 1. In this position, the piston is at its normal maximum up position and the valve is in its normal maximum down position.

Figure 2:
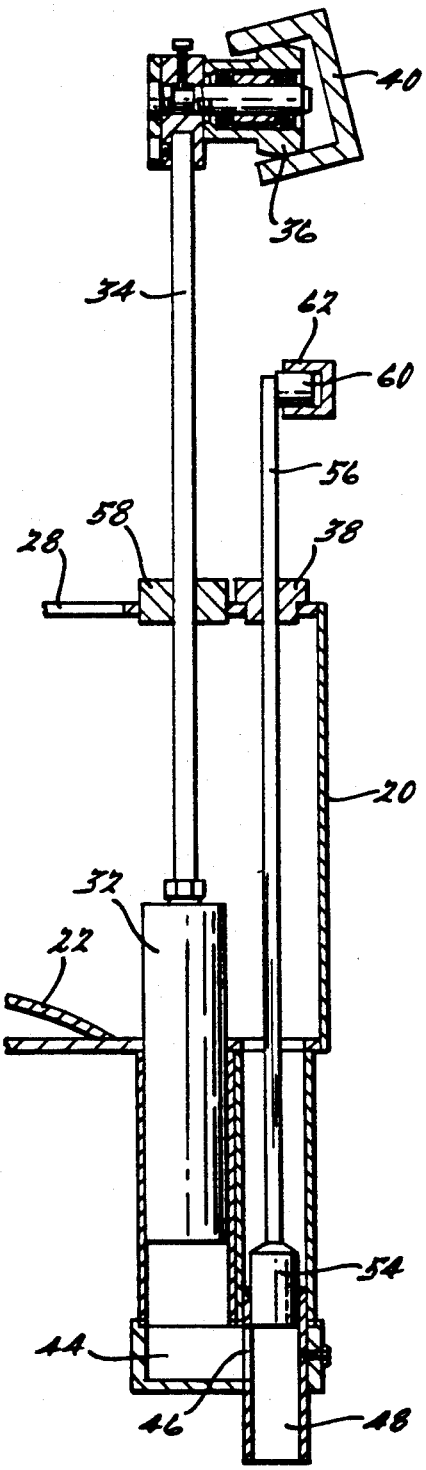
FIG. 2 is a view similar to FIG. 1 showing a portion of the apparatus but in a third filling position.

C. This is the start of container fill position. In this position both the piston and valve are at their normal maximum up positions, as shown in FIG. 2.

D. This is the end of container fill position. In this position the piston is in its normal maximum down position and the valve is in its normal maximum up position. This position can be easily visualized from the drawings.

A. The cycle repeats.

Figure 5:
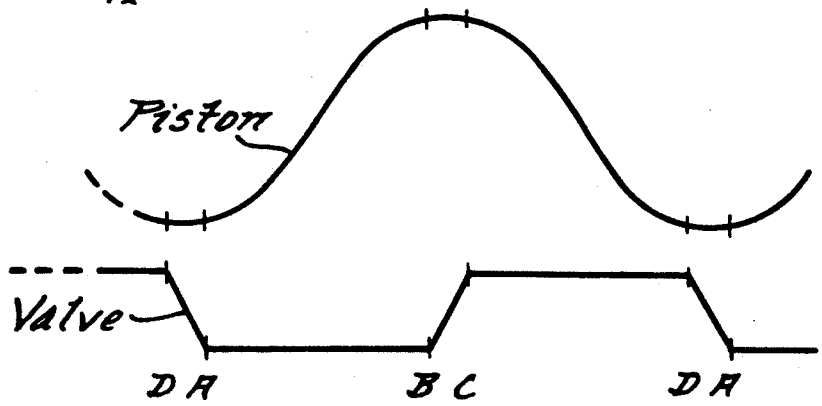
FIG. 5 is a graph representing the projected view of the profile of two cams utilized in the preferred embodiment of the present invention.

The respective positions of each piston 32 and each corresponding valve 54 as the bowl rotates through a single 360° cycle is illustrated in FIG. 5 in which the vertical axis represents vertial displacement of the cams, and hence the valve or piston, and the horizontal axis represents degrees of rotation of the bowl, one cycle being 360° in the exemplary machine shown (i.e., the space between the first "A" and the second "A" represents 360° of rotation of the bowl).

In actual operation, with reference to FIGS. 1, 2 and 5, as a given piston/valve combination moves from position "A" to position "B", the piston draws product from bowl 20 down through valve cylinder 42 through passageway 46 into piston cylinder 32, this action being achieved by both the vacuum created by movement of the piston upwardly in its cylinder and also by virtue of gravity which assists in causing the product to fall downwardly into valve cylinder 42. Because valve 54 is in its lowermost position, passage 46 is open and the dispensing nozzle is closed. Between positions "B" and "C" the valve moves from its lower position to its upper position to open the dispensing nozzle. From position "C" to position "D" the piston moves downwardly to force the measured quantity product therein (as predetermined by the piston stroke deferred by the disposition of cam 40) through passage 46 and downwardly out the dispensing nozzle into the container 19 disposed therebelow. Product is not pushed up into valve cylinder 42 because valve 54 is in its uppermost seated position. From position "D" to "A" the valve moves from its upper position to its lower position and the cycle repeats itself. The same cycle occurs with respect to each of the piston/valve cylinder pairs as they rotate 360° about the axis of shaft 14. All of the parts of the apparatus which contact the food product are of materials approved for such applications, such as stainless steel, ceramic or the like.

Figure 3:
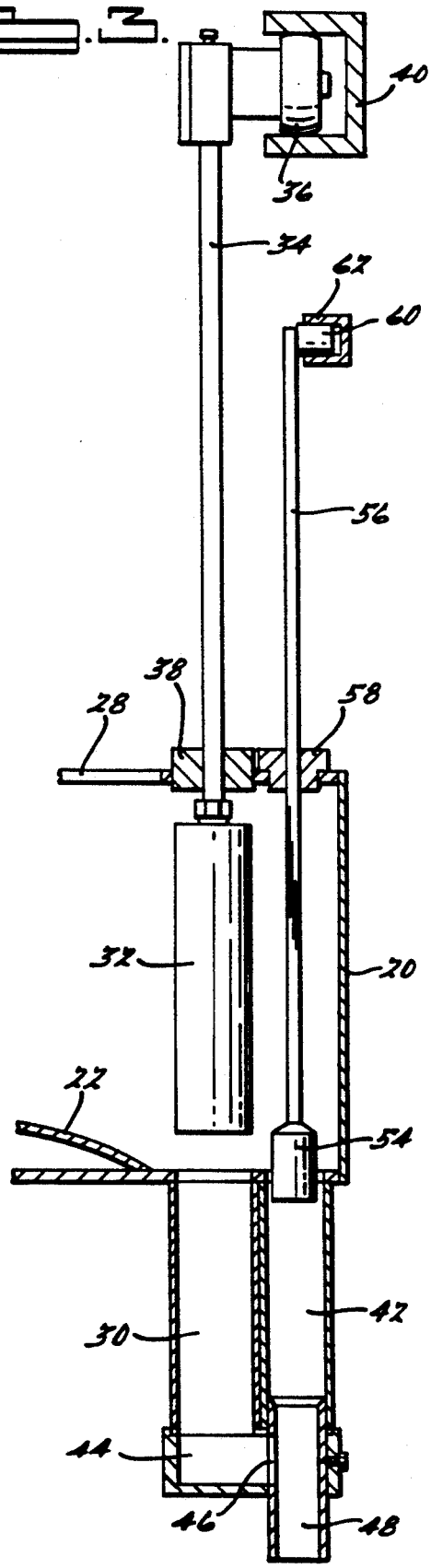
FIG. 3 is a view similar to FIG. 1 showing a portion of the apparatus but in a fourth cleaning position.
Figure 4:
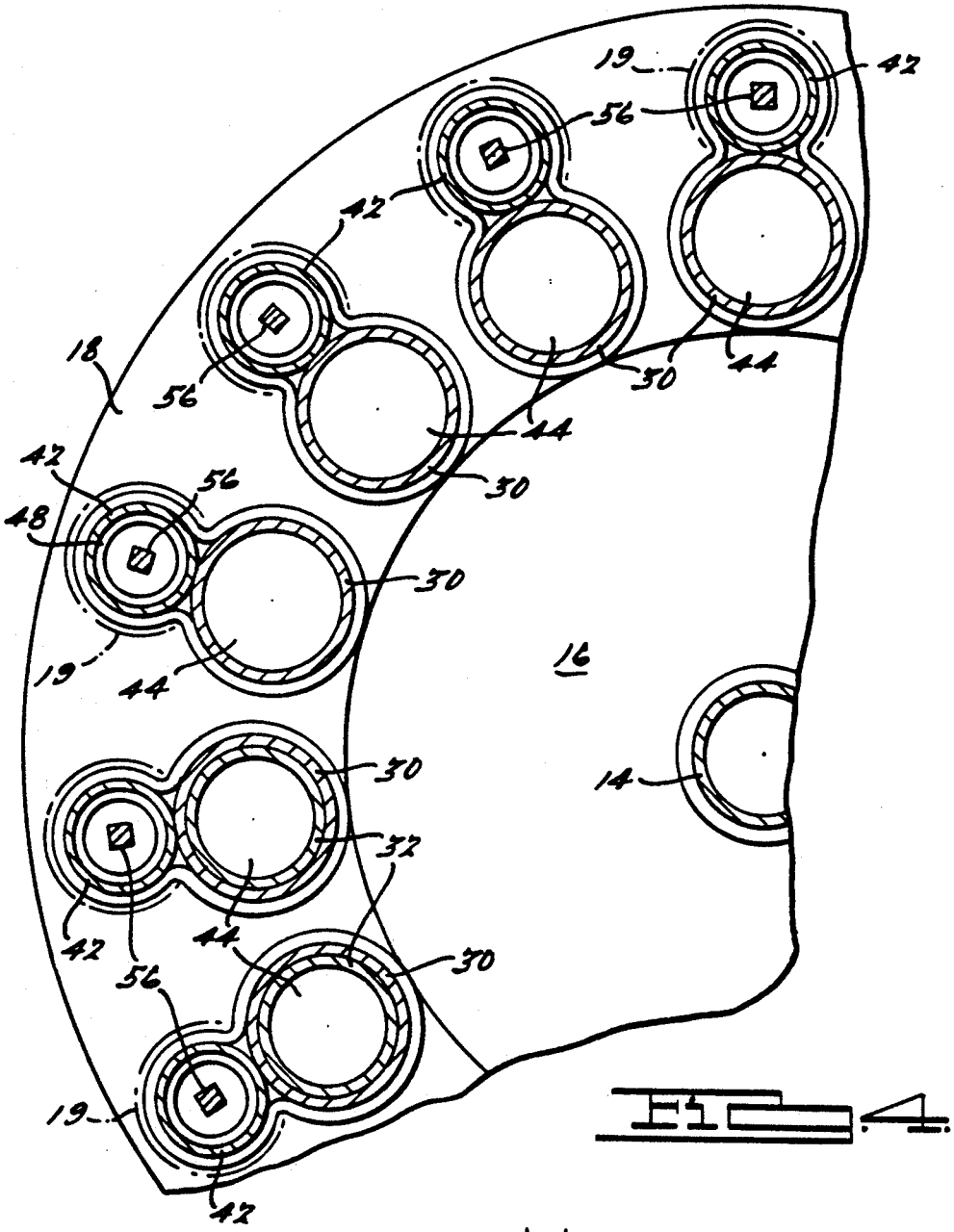
FIG. 4 is a fragmentary horizontal sectional view taken generally along line 4—4 in FIG. 1.

The utter simplicity of the apparatus is apparent from the drawings. There are no special cock-type valves which need to be opened or closed and thus removed for cleaning, nor are there any unusual seals requiring disassembly. The valving function performed by valve 54 is very simple and it operates in a smooth sleeve without any special additional seals. Cleaning is very easily effected with all of the components in place by merely actuating each piston 32 and each valve 54 to the positions illustrated in FIG. 3. In this position, piston 32 is raised up into bowl 20, out of cylinder 30 and valve 54 is raised until it is at least partially within bowl 20 and in any case within the significantly larger opening where valve cylinder 42 joins the bottom of bowl 20. In this position, cleaning is easily effected by filling bowl 20 with a suitable cleaning solution and recirculating it from the bowl out through the dispensing nozzles into a collector ring (not shown) disposed on surface 18 and then back into the bowl. Because of all the open clearances and the full exposure of all food contacting parts cleaning is very simply and quickly effected. If desired, the rods can also be cycled in the presence of cleaning fluid to further enhance cleaning. Piston and cylinders may be raised in the cleaning position by either detaching them singularly or as a group from the cams and manually raising them, or by simply raising both the cams, whichever is desired.

The apparatus of the present invention readily lends itself to a alternative mode of operation which permits the filling of very dense or heavy food products. In accordance with this option, piston 32 is raised to the position shown in FIG. 3 so as to permit food to fall, at least in part, by gravity into piston cylinder 30 and at the same time valve 54 is actuated to its lowermost position to prevent the food from falling out the dispensing nozzle. With the valve remaining in that same lowered position, the piston is then brought down to push the food downwardly into the piston cylinder 30 with the overflow flowing up valve tube 42 until the proper metered amount is in position. Valve 54 is thereafter moved to its uppermost position to place passage 46 in communication with the dispensing nozzle and the piston 32 is moved further to its lowermost position to dispense the product therebelow out the dispensing nozzle into the container. Operation in this mode is good for heavy products because it does not require a vacuum and thus no air is introduced into the charge being dispensed.

The invention is also applicable to such apparatus where the filling pistons are in line (rather than in a circle), or where each filler piston stands alone. Furthermore, if desired, the filler pistons and valves may be actuated hydraulically or pneumatically or by means of a crank mechanism (rather than by using annular cams).

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

What is claimed is:

1. A piston filler comprising:

(a) a stationary base;

(b) powered motor means on said base;

(c) a vertically extending shaft journaled on said base and rotationally driven about an axis by said motor means;

(d) a platform affixed to said shaft for rotation therewith having a container supporting surface on the upper face thereof;

(e) a bowl for holding product to be filled into containers, said bowl being affixed to said shaft for rotation therewith and having an outer peripheral filling zone from which product can be transferred to the containers on said supporting surface of said platform;

(f) a plurality of piston cylinders depending downwardly from the bottom of said bowl adjacent the outer periphery thereof, said piston cylinders having open upper ends in communication with the interior of said bowl in said filling zone;

(g) a piston mounted for reciprocating movement in each of said piston cylinders;

(h) means for causing said pistons to reciprocate in their respective piston cylinders when said shaft is rotated, said pistons being selectively reciprocated between first and second positions and between first and third positions, wherein each of said pistons is at a lower portion of said piston cylinder when in said first position, each of said pistons is at an upper portion of said piston cylinder when in said second position, and each of said pistons is withdrawn from the upper portion of said piston cylinder and fully into said bowl when in said third position;

(i) a valve cylinder depending downwardly from the bottom of said bowl adjacent each one of said piston cylinders, each said valve cylinder having the upper end thereof open and in communication with the interior of said bowl in said filling zone;

(j) a passage interconnecting each piston cylinder with its associated valve cylinder in the vicinity of the lower end thereof;

(k) first and second valve seats in said valve cylinder above and below said passage, respectively;

(l) a valve mounted for reciprocating movement in each of said valve cylinders for sealing engagement with either one of said valve seats;

(m) means for causing said valves to reciprocate in both directions in their respective valve cylinders when said shaft is rotated, each valve moving between a first position in which it engages said first seat but not said second seat and a second position in which it engages said second seat but not said first seat and is disposed below said passage; and (n) a discharge nozzle disposed at the lower end of each of said valve cylinders for dispensing product from the adjacent piston cylinder through said passage into a container disposed below said nozzle on said support surface.

2. A piston filler as claimed in claim 1 wherein said piston cylinders and valve cylinders are mounted in side-by-side pairs.

3. A piston filler as claimed in claim 2 wherein said valve cylinders are mounted radially outwardly from said said piston cylinders.

4. A piston filler as claimed in claim 1 wherein each said valve cylinder comprises a first relatively large cylinder member affixed at its upper end to said bowl and a second smaller cylindrical sleeve affixed adjacent its lower end.

5. A piston filler as claimed in claim 4 wherein said valve seats are defined by the inside surface of said cylindrical sleeve.

6. A piston filler as claimed in claim 4 wherein each said valve is cylindrical in configuration and of smaller diameter than said first cylindrical member whereby there is significant clearance about the outside of said valve when disposed in said cylinder member.

7. A piston filler as claimed in claim 4 wherein said passage is through the wall of said sleeve intermediate its ends.

8. A piston filler as claimed in claim 1 wherein each said valve can be actuated at least partially into said bowl.

9. A piston filler comprising:

a) a base;

b) a platform mounted to said base and having a container supporting surface on the upper face thereof;

c) a means for moving the platform on said base;

d) a bowl for holding product to be filled into containers, said bowl having a filling zone from which product can be transferred to one or more containers on said supporting surface of said platform;

e) a piston cylinder depending downwardly from the bottom of said bowl, said piston cylinder having an open upper end in communication with the interior of said bowl in said filling zone;

f) a piston mounted for reciprocating movement in said piston cylinder;

g) means for causing said piston to reciprocate in both directions in said piston cylinder when said platform is moved, said piston being selectively reciprocated between a first position in which a lower end of said piston is disposed adjacent a lower end of said piston cylinder, and a second position in which the lower end of said piston is disposed above the upper end of said piston cylinder such that said bowl is in communication with a portion of said piston cylinder below said piston;

h) a valve cylinder depending downwardly from the bottom of said bowl adjacent said piston cylinder, said valve cylinder having the upper end thereof open and in communication with the interior of said bowl in said filling zone;

i) a passage interconnecting said piston cylinder with said valve cylinder in the vicinity of the lower end thereof;

j) valve means for controlling product flow through said passage and into said piston and valve cylinders; and k) a discharge nozzle disposed at the lower end of said valve cylinder for dispensing product into a container disposed below said nozzle on said supporting surface.

10. A piston filler as claimed in claim 9 further comprising means for causing said valve to reciprocate in both directions in its valve cylinder between a first position in which it engages a first seat but not a second seat and a second position in which it engages said second seat but not said first seat and is disposed below said passage.

11. A piston filler comprising:

(a) a stationary base;

(b) powered motor means on said base;

(c) a vertically extending shaft journaled on said base and rotationally driven about an axis by said motor means;

(d) a generally circular and horizontal platform affixed to said shaft for rotation therewith, said platform having a generally annular container supporting surface on the upper face thereof substantially coaxial with said axis;

(e) a generally circular cylindrical bowl for holding product to be filled into containers, said bowl being affixed to said shaft for rotation therewith, said bowl being generally coaxial with said axis and being disposed above said platform, said bowl and platform being of roughly the same diameter;

(f) an arched dome centrally disposed in the bottom of said bowl for causing product in said bowl to flow radially outwardly to the outer generally annular bottom surface of said bowl thereby creating a filling zone from which product can be transferred to the containers on said supporting surface of said platform;

(g) a plurality of generally vertical circular piston cylinders depending downwardly from the bottom of said bowl adjacent the outer periphery thereof, said piston cylinders being generally equally spaced and of equal length with the upper ends thereof being open and in communication with the interior of said bowl in said filling zone;

(h) a piston mounted for reciprocating movement in each of said piston cylinders in a closely fit relation thereto;

(i) a generally vertical piston rod affixed at the lower end thereof to each of said pistons, and a follower at the upper end of each of said piston rods;

(j) a stationary circular first cam disposed above said bowl generally coaxial therewith, each of said piston rod followers adapted to engage said first cam whereby the latter will cause the pistons to reciprocate in both directions in their respective piston cylinders when said shaft is rotated, each said piston being actuated between a first position in which the lower end thereof is disposed adjacent the lower end of said piston cylinder, and a second position in which the lower end of said piston is disposed above the upper end of said piston cylinder such that said bowl is in communication with a portion of said piston cylinder below said piston;

(k) a generally vertical circular valve cylinder depending downwardly from the bottom of said bowl adjacent each one of said piston cylinders, each said valve cylinder having the upper end thereof open and in communication with the interior of said bowl in said filling zone;

(l) a passage interconnecting each piston cylinder with its associated valve cylinder in the vicinity of the lower end thereof;

(m) first and second valve seats in said valve cylinder above and below said passage, respectively;

(n) a valve mounted for reciprocating movement in each of said valve cylinders for sealing engagement with either one of said valve seats;

(o) a generally vertical valve rod affixed at the lower end thereof to each of said valves, and a follower at the upper end of each of said valve rods;

(p) a stationary circular second cam disposed above said bowl generally coaxial therewith, each of said valve rod followers adapted to engage said second cam whereby the latter will cause the valves to reciprocate in both directions in their respective valve cylinders when said shaft is rotated, each valve moving between a first position in which it engages said first seat but not said second seat, and a second position in which it engages said second seat but not said first seat and is disposed below said passage; and (q) a discharge nozzle disposed at the lower end of each of said valve cylinders for dispensing product from the adjacent piston cylinder through said passage into a container disposed below said nozzle on said supporting surface.

12. A piston filler comprising:

a) a container supporting surface;

b) a bowl for holding product to be filled into containers, said bowl having a filling zone from which product can be transferred to one or more containers on said supporting surface;

c) a piston cylinder depending downwardly from the bottom of said bowl, said piston cylinder having a lower end and an open upper end in communication with the interior of said bowl in said filling zone such that said product is received by said open upper end;

d) a piston mounted for reciprocating movement in said piston cylinder such that said product received by said open upper end is forced into said lower end by the reciprocating movement of said piston;

e) a valve cylinder depending downwardly from the bottom of said bowl, said valve cylinder having the upper end thereof open and in communication with the interior of said bowl in said filling zone such that said product is received by said upper end;

f) a passage interconnecting said lower end of said piston cylinder with said valve cylinder in the vicinity of a lower end thereof;

g) valve means for controlling product flow through said passage and into said piston and valve cylinders; and h) a discharge nozzle disposed at the lower end of said valve cylinder for dispensing said product received by said valve cylinder and said piston cylinder into a container disposed below said nozzle.

* * * * *